United States Patent [19]

Hunley

[11] 4,058,309

[45] Nov. 15, 1977

[54] BOWLING PIN WIRE GUIDE SLEEVE

[76] Inventor: Walter T. Hunley, 6134 Music St., New Orleans, La. 70122

[21] Appl. No.: 744,389

[22] Filed: Nov. 23, 1976

Related U.S. Application Data

[63] Continuation of Ser. No. 603,911, Aug. 12, 1975, abandoned.

[51] Int. Cl.[2] ..... A63D 5/08; B23P 7/04

[52] U.S. Cl. ..... 273/43 D; 29/402; 52/514

[58] Field of Search ..... 273/42 R, 42 A, 43 R, 273/43 A, 43 D; 272/56.5 R; 193/38, 41; 29/401 R, 402; 52/514

[56] References Cited

U.S. PATENT DOCUMENTS

| | | | |
|---|---|---|---|
| 2,841,396 | 7/1958 | Foss | 272/56.5 R |
| 3,018,103 | 1/1962 | Albrecht | 273/43 D |
| 3,499,648 | 3/1970 | Huck et al. | 273/43 D |
| 3,686,888 | 8/1972 | Helton | 193/41 X |

*Primary Examiner*—Anton O. Oechsle

*Attorney, Agent, or Firm*—Wilkinson, Mawhinney & Theibault

[57] ABSTRACT

The present disclosure is directed to a guide sleeve which passes over and about the vertical legs of a bowling pin wire guide and which has a web between the vertical legs to distribute the shock impact or force of the bowling pin striking the wire guide evenly between the two vertical legs and to confine each vertical leg should a break in the leg occur whereby the sleeve acts as a mechanical continuity.

3 Claims, 4 Drawing Figures

BOWLING PIN WIRE GUIDE SLEEVE

This application is a continuation of Ser. No. 603,911 filed Aug. 12, 1975, having the same title and inventor and now abandoned.

THE PRIOR ART

The problem solved by the instant invention occurs in a Brunswick automatic bowling pin setting mechanism where the pin wire guides for the 1,7 and 10 pins frequently break from impact of the bowling pins thereagainst. These pin wire guides must then be removed, welded at the break and replaced resulting in appreciable down time of the alley causing a loss of revenue from alley operation.

An object of the present invention is the provision of a pin wire guide sleeve for use with a pin wire guide employed on a Brunswick type pin setting mechanism wherein the pin wire guide is designated as T-197 12150295 pin guide.

A further object of the present invention is the provision of a guide sleeve which may be quickly installed or removed not requiring welding or extended down time of the alley.

A still further object of the present invention is the provision of a guide sleeve wherein the web between the pin wires between the pin wire engaging channels is concave relative to the pin which will strike it to more nearly conform to the external geometry of the bowling pin so as to result in less marking or damage to the bowling pin.

With the foregoing and other objects in view the invention will be more fully described hereinafter and more particularly pointed out in the appended claims.

In the drawings in which like parts are denoted by reference characters throughout the several views.

Figure 2:
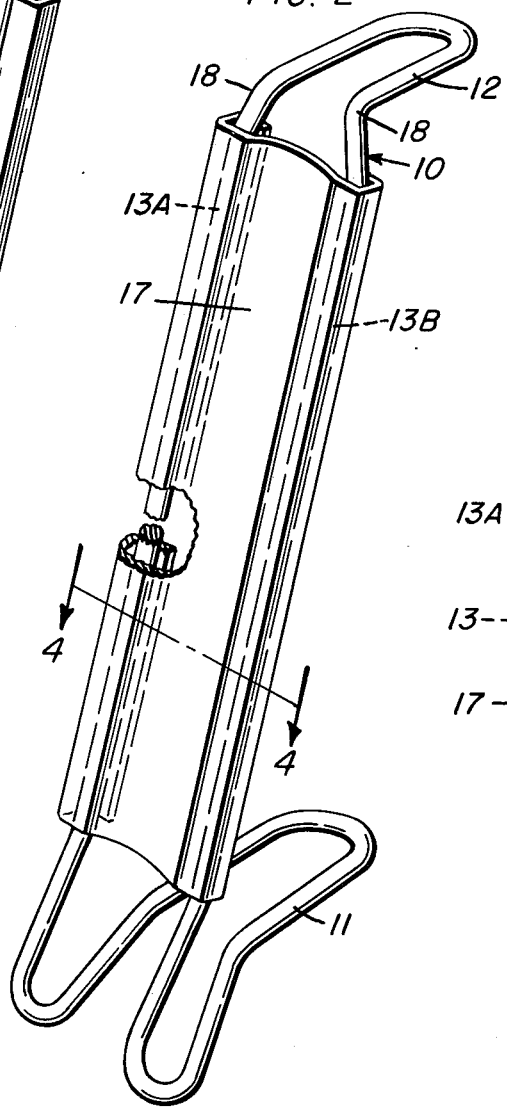
FIG. 2 is a perspective view of the pin wire guide sleeve of the present invention installed on a pin wire guide.
Figure 3:
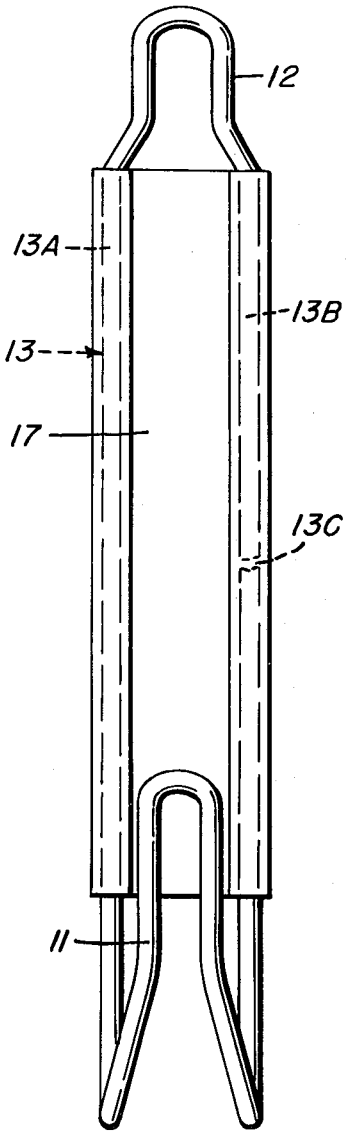
FIG. 3 is a front elevational view of the sleeve and pin wire guide of FIG. 2.

Referring now to the drawings and for the moment to FIGS. 2 and 3, 10 designates generally a Brunswick pin wire guide employed for pins 1,7 and 10 of the Brunswick automatic bowling pin setting mechanism having a base 11 and a top 12. The pin wire guide has an intermediate portion 13 composed of two wires 13A and 13B which run substantially parallel. It is the portions 13A and 13B which are most frequently broken and which require welding.

Figure 1:
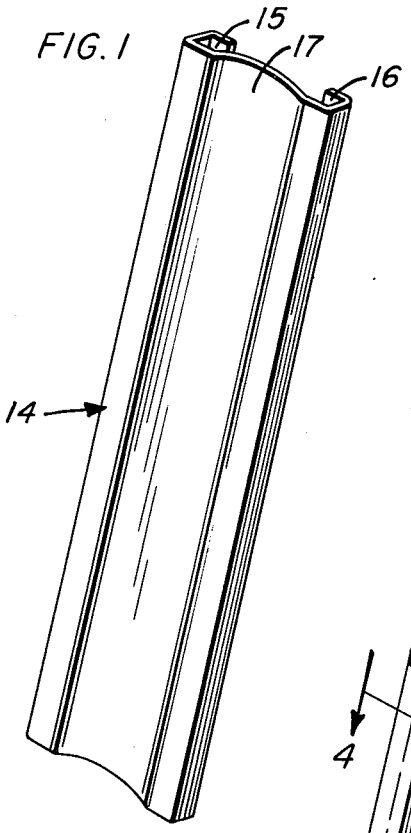
FIG. 1 is a perspective view of a pin wire guide sleeve constructed in accordance with the present invention.

The pin wire guide sleeve 14 as shown in FIG. 1 has a pair of channel guides 15 and 16 having a concave web 17 therebetween. The channel guides have flanges 15A and 15B which seat behind the two wires 13A and 13B and which slide down over the wires just below a bend 18 between the wires 13A and 13B and the top 12, as best seen in FIG. 2.

Figure 4:
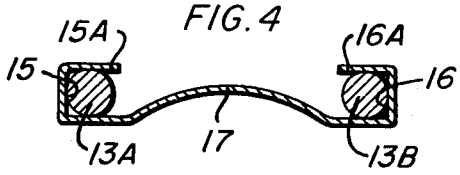
FIG. 4 is a transverse section taken on the lines 4—4 in FIG. 2.

As can be seen in FIG. 4, the channel guides engage at least the forwardmost and rearwardmost portions of the wires 13A and 13B to provide longitudinal support and physical restraint of wires along the length of sleeve 14.

The guide sleeve 14 acts as a load impact distributor between the parallel wires 13A and 13B and should either wire become broken the sleeve 14 acts as a splint. The wires if broken can be welded with the sleeve in place or the sleeve can be slid upwardly, the wires welded and the sleeve slipped back in place as shown in FIG. 2. FIG. 3 shows a break 13C in the wire leg 13B but the channel guide 16 to each side of the break holds the unit together so it will function just like a new pin wire guide with a minimum of down time to the alley.

What I claim is:

1. In combination, a bowling pin wire guide having a pair of laterally spaced apart parallel guide wires joined by a closed loop at the top and being bent rearwardly, a pin wire guide sleeve comprising a longitudinally extending straight web the length of which exceeds one half the length of the parallel guide wires, channel means extending from each side of the web adapted to slip over and engage the forwardmost and rearwardmost portions of the spaced apart parallel guide wires below the bend of said closed loop to confine the spaced apart guide wires within the channel means and provide longitudinal support and physical restraint in the area of any breaks along said parallel guide wires, and said longitudinally extending web being concave but straight on one of its sides.

2. The combination of claim 1 wherein at least one of the laterally spaced apart parallel guide wires has a break along its major axis.

3. In combination, a bowling pin wire guide having a pair of laterally spaced apart parallel guide wires joined by a closed loop at the top and being bent rearwardly, a pin wire guide sleeve comprising a longitudinally extending straight web the length of which exceeds one half the length of the parallel guide wires, pin wire guide engaging means extending from each side of the web adapted to slip over and engage opposite front and rear sides of the spaced apart parallel guide wires below the bend of said closed loop and confine the spaced apart guide wires within the pin wire guide engaging means to provide longitudinal support and positive front and rear engagement of said sleeve and said parallel guidewire in the area of any breaks along said parallel guide wires, and said longitudinally extending web being concave on one of its sides.

* * * * *